US006983500B2

(12) United States Patent
Wootten

(10) Patent No.: US 6,983,500 B2
(45) Date of Patent: Jan. 10, 2006

(54) FITTED SHEETS WITH ELASTIC SIDE SEGMENTS

(76) Inventor: Gerald E. Wootten, 298 County Road 1468, Cullman, AL (US) 35058

( * ) Notice: Subject to any disclaimer, the term of this patent is extended or adjusted under 35 U.S.C. 154(b) by 12 days.

(21) Appl. No.: 10/651,256

(22) Filed: Aug. 29, 2003

(65) Prior Publication Data

US 2004/0068794 A1 Apr. 15, 2004

Related U.S. Application Data

(63) Continuation-in-part of application No. 10/231,050, filed on Aug. 30, 2002, now abandoned.

(51) Int. Cl.
*A47G 9/04* (2006.01)

(52) U.S. Cl. ..... 5/497
(58) Field of Classification Search ..... 5/495, 5/496, 497
See application file for complete search history.

(56) References Cited

U.S. PATENT DOCUMENTS 2,624,893 A 1/1953 Harris
3,013,283 A 12/1961 Steffinich
3,114,156 A 12/1963 Cobb
4,980,941 A 1/1991 Johnson
5,029,353 A 7/1991 Kimball et al.
5,479,664 A 1/1996 Hollander
5,513,403 A 5/1996 Wootten

*Primary Examiner*—Frederick L. Lagman
(74) *Attorney, Agent, or Firm*—Dykema Gossett PLLC

(57) ABSTRACT

A fitted cornerless bedclothing item such as a sheet, mattress pad, anti-allergy cover, blanket or coverlet includes a top portion, side portions and end portions, and elastic segments stitched to edges of respective side and end portions. One or more elastic bindings are provided at lower edges of the side and end portions to cause the tops of the elastic segments to be positioned below the respective upper corners of the mattress on which the bedclothing item is mounted, such that no ears or pockets are formed when the bedclothing item is mounted on mattresses of at least two different sizes and/or thicknesses. The elastic segments are made of knitted or woven elastic filaments, such as SPANDEX® fabric, and can be shaped to have a straight lower edge and a curved upper edge, the curved upper edge advantageously approximating an end of an ellipse.

20 Claims, 2 Drawing Sheets

FITTED SHEETS WITH ELASTIC SIDE SEGMENTS

CROSS-REFERENCE TO RELATED APPLICATION

This application is a continuation-in-part of application Ser. No. 10/231,050, filed Aug. 30, 2002 (now abandoned), the priority of which is hereby claimed.

BACKGROUND OF THE INVENTION

1. Field of the Invention

The present invention relates to bedding, and in particular to fitted bedclothes for a mattress.

2. The Prior Art

Fitted bedclothes for mattresses, e.g., fitted sheets, mattress pads, blankets, anti-allergy covers and coverlets (hereinafter referred to as fitted bedclothing items, or in the singular as a fitted bedclothing item) are of course well known and conventionally provide a top portion which is sized to cover the top surface of the mattress, and side and end portions which cover the sides and ends of the mattress, the lower edges of the side and end portions usually including an elastic to cause the lower areas of the side and end portions to extend inwardly under the lower surface of the mattress to help tighten the fitted bedclothing item around the mattress and securely position it in place. The corners of the fitted bedclothing items, which are formed by connecting the side and end portions by stitching to form upwardly-extending seams, fit tightly against the corners of the mattress. In addition, it is known to connect elastic strips between the lower edges of respective adjacent side and end portions of a fitted sheet to better retain the sheet on the mattress (see my U.S. Pat. No. 5,513,403).

However, such prior art fitted bedclothing items are specifically sized to fit mattresses having certain horizontal dimensions (lengths and widths) and certain thicknesses, and cannot fit mattresses having differing horizontal dimensions and/or different thicknesses. This forces retailers and wholesalers of the bedclothing items to stock a large inventory sufficient to fit the different horizontal dimensions and vertical thicknesses of mattresses currently available, which in the U.S. market include twin, twin XL, full, full XL, queen, California queen, Olympic queen, Eastern king and California king, all of which can be purchased in vertical thicknesses from 4 to over 20 inches when taking into consideration pillow-top upper surfaces. It also forces purchasers to buy specifically-sized fitted bedclothing items for each size of mattress in their household or establishment. In addition, the sewn vertical corners of the fitted bedclothing items create undesirable ears or pockets (bulges) at the upper ends of the seams which extend upwardly of the upper surface of the bedclothing item when placed on a mattress.

A need exists for fitted bedclothing items which can be satisfactorily used with mattresses of at least two differing horizontal sizes and/or vertical thicknesses, thus reducing the number of sizes of fitted bedclothing items that the wholesaler and retailer must stock and the number of different sizes of bedclothing items that the purchaser needs to buy. A need also exists for fitted bedclothing items which, when mounted on a mattress, will have no seam ears or pockets at its corners.

SUMMARY OF THE INVENTION

According to this invention, a fitted bedclothing item, such as a sheet, mattress pad, anti-allergy cover, blanket or coverlet which can be made of commonly used fabric materials, such as cotton, linen, flannel, satin, sateen, etc., includes a top portion, opposite side portions and opposite end portions, and elastic segments connected between adjacent edges of respective side and end portions, such elastic segments providing the flexibility to enable the bedclothing item to satisfactorily fit around and under mattresses of at least two differing horizontal sizes and/or vertical thicknesses. Such elastic segments will not create ears or pockets as with prior art bedclothing items. Each of the elastic segments is made of an elastic material containing elastic filaments that are preferably woven or knitted, such as SPANDEX® fabric.

A better understanding of the invention will be had by reference to the accompanying drawings, taken in conjunction with the following discussion.

DETAILED DESCRIPTION OF THE PREFERRED EMBODIMENT

Figure 1:
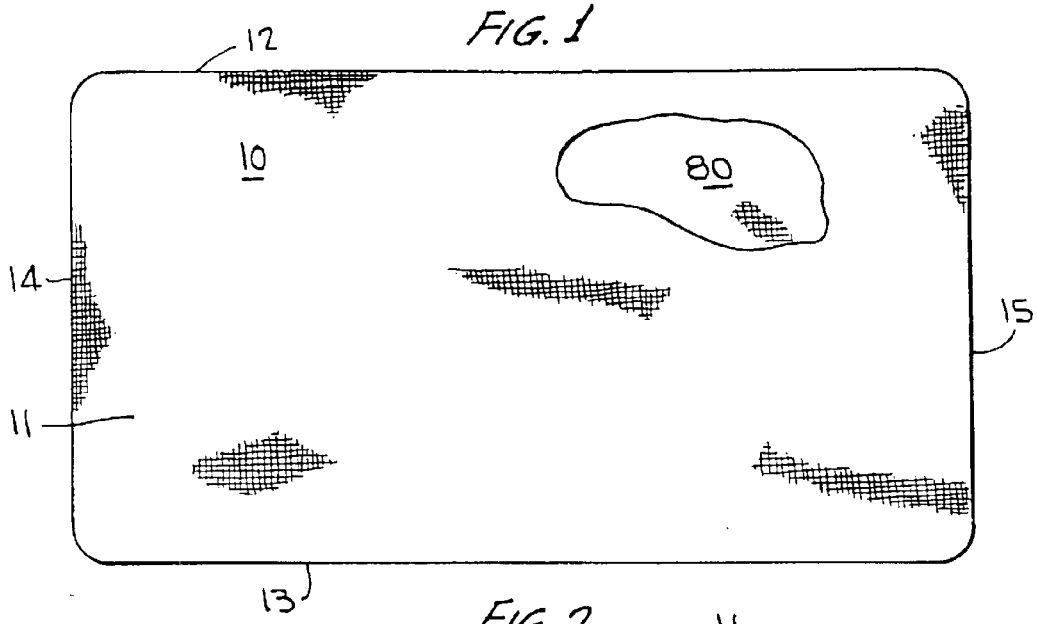
FIG. 1 is a top view of a fitted bedclothing item in the form of a sheet according to a preferred embodiment of the invention when mounted on a mattress of a first horizontal size and thickness.
Figure 2:
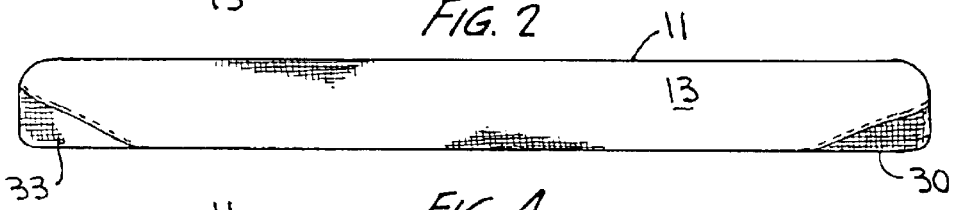
FIG. 2 is a side view of the fitted sheet and mattress of FIG. 1.

A fitted sheet 10 according to a preferred embodiment of the present invention is shown in FIGS. 1–7. In FIGS. 1 and 2 the sheet 10 is shown mounted on a mattress 80 having a first horizontal size and thickness, and in FIGS. 3 and 4 it is shown mounted on a mattress 81 having a second horizontal size and thickness. More specifically, the mattress 80 is a full size having a thickness of 12 inches and mattress 81 is a queen XL (extra long) size having a thickness of 16 inches. The sheet 10, which is made of a conventional fabric material, provides a top portion 11, opposite side portions 12 and 13, and opposite end portions 14 and 15. An elastic binding 20 is attached to the lower edges of the side and end portions in a conventional manner to secure the sheet on the mattress, and elastic strips 25–28 are connected to the lower edges of adjacent side and end portions so as to help retain the sheet on the mattress.

Figure 4:
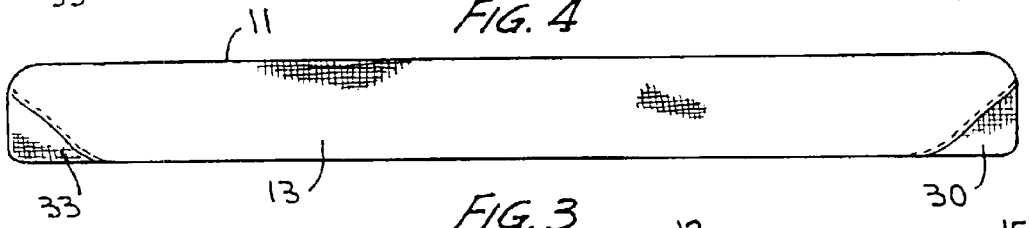
FIG. 4 is a side view of the fitted sheet and mattress of FIG. 3.
Figure 3:
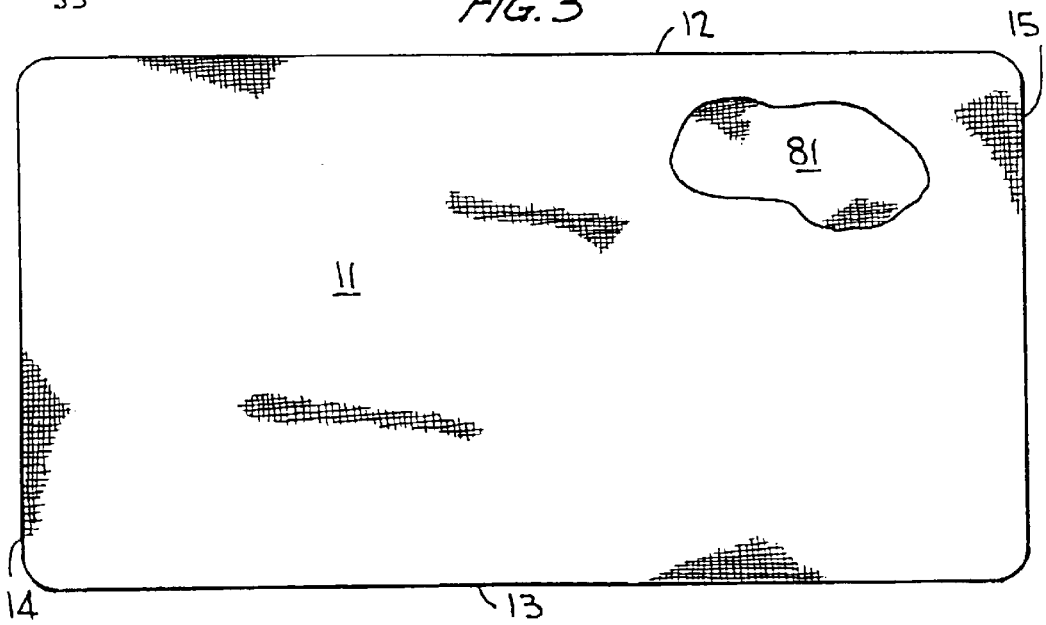
FIG. 3 is a top view of the fitted sheet of FIG. 1 when mounted on a mattress of a second, larger horizontal size and thickness.
Figure 5:
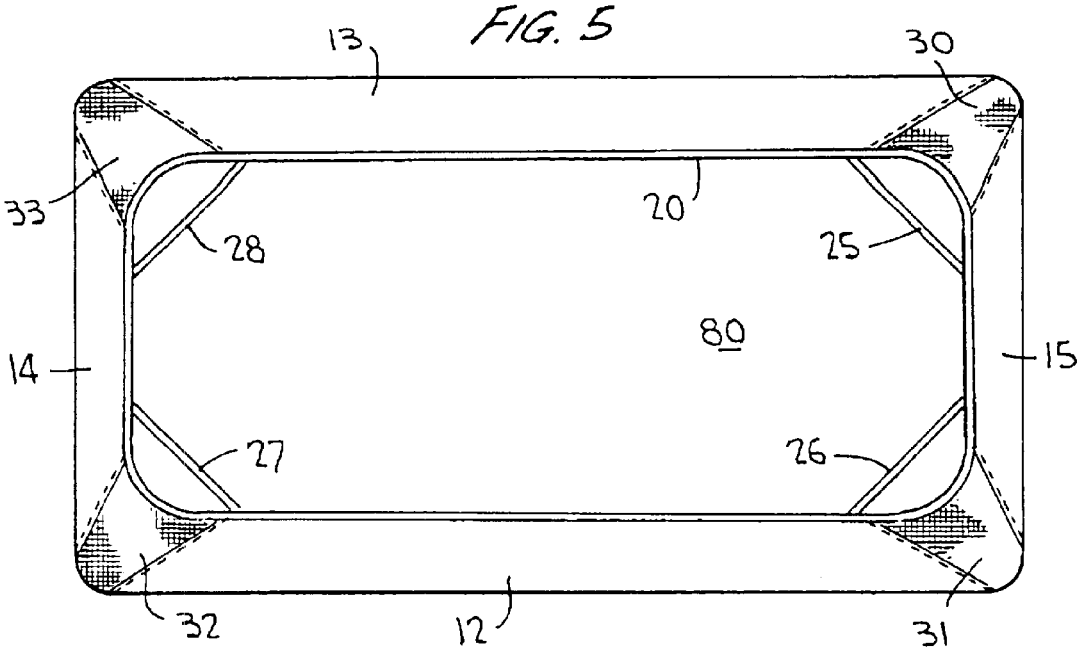
FIG. 5 is a bottom view of the fitted sheet and mattress of FIG. 3.

The side and end portions of the sheet 10 are not straight edged and sewn together to form fixed upwardly-extending seams as in prior art fitted sheets, but instead define curved edges, and respective elastic segments 30, 31, 32 and 33 are connected therebetween and to the elastic band 20. These elastic segments, which can be connected to the adjacent side edges of the side and end portions of the sheet 10 by stitching 50 (see FIG. 7), provide such flexibility along the sides of the sheet that the sheet can be easily stretched to fit a wider, longer and thicker mattress, as shown in FIGS. 3 and 4. For example, a sheet of the invention which fits a standard twin size mattress of a first thickness also fits a twin size XL of a second thickness, a sheet which fits a full size mattress of a first thickness also fits a queen size mattress of a second thickness, a sheet sized which fits a California queen mattress of a first thickness also fits an Olympic queen of a second thickness, a sheet which fits an Eastern king of a first thickness also fits a California king mattress of a second thickness, etc. As such, a retailer can stock far fewer sizes of fitted sheets and still accommodate all the mattress sizes on the market.

Figure 6:
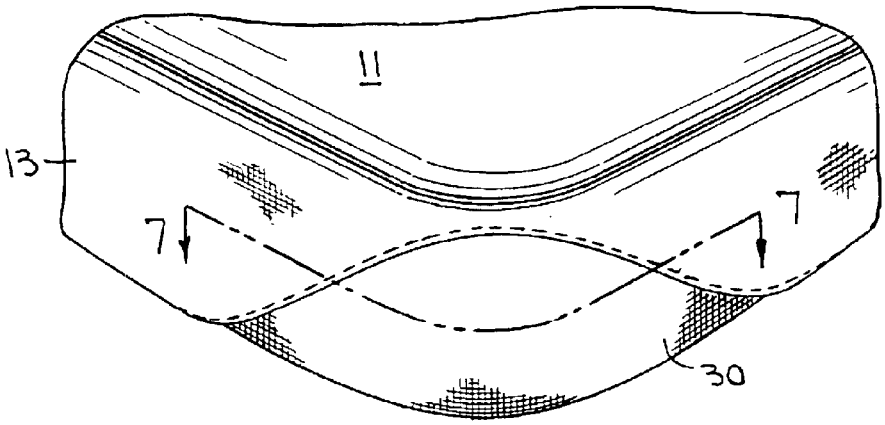
FIG. 6 is a top perspective view of a corner of the fitted sheet and mattress of FIG. 1.
Figure 7:
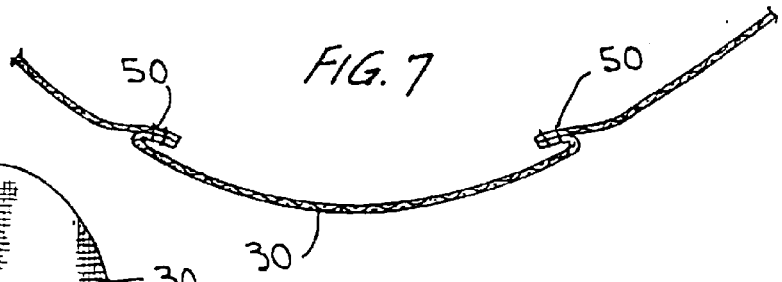
FIG. 7 is a view of the fitted sheet in FIG. 6 as seen along line 7—7.

When the sheet 10 of the invention is fitted on a mattress for which it is designed, elastic band 20 will cause the tops of the segments 30, 31, 32 and 33 to be located below the upper corners of the mattress (see FIG. 6). As such, the sheet 10 can be termed cornerless, and no ears or pockets of sheet material will be created. It should be noted that the elastic segments 30, 31, 32 and 33 in fact need not be located relative to the sides and ends of the sheet so as to be exactly centered at the corners of the mattress on which the sheet is fitted but can be somewhat off centered relative thereto. This is advantageous because the lack of criticality in the location of these segments lowers the cost of production insofar as it reduces the number of products which must be considered irregular, miscut or poor fitting.

Figure 8:
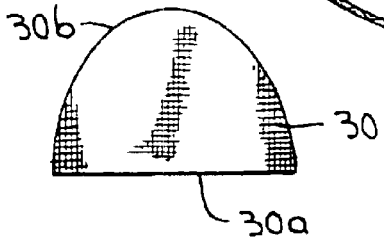
FIG. 8 is a view of an elastic segment used in a corner of the fitted sheet of FIG. 1.

As shown in FIG. 8, the unstretched elastic segments are shaped to have a generally straight lower edge 30*a* (the edge attached to the elastic band 20) and a curved upper edge 30*b*, which extends from one end of the lower edge to an opposite end, generally conforms to the curve at an end of an ellipse. The opposite sides of the curved upper edge are connected to the respective side and end portions of the sheet 10. The lower edge can, for example, be 28 inches long, and the maximum height of the upper edge thereabove can be, say, 24 inches.

Although a preferred embodiment of the invention has now been shown and described, modifications therein can be made and still fall within the scope of the appended claims. For example, the invention can be applied to fitted mattress pads of the type wherein the pad extends along the sides and ends of the mattress, fitted blankets, fitted anti-allergy covers and fitted coverlets such as comforters. And the elastic segments can have shapes other than as shown in FIG. 8, e.g., the upper edges 30*b* can be circular or crescent-shaped or some other curved configuration; indeed, the segments can be square or rectangular or any other shape which will provide the desired stetching ability. Furthermore, the bedclothing item need not include an elastic binding that extends along the entirety of the lower edges of the side and end portions, but can include separate elastic bindings in only the areas where the elastic segments are located. Also the elastic strips 25–28 are not essential but are optional for fitting purposes.

I claim:

1. A fitted bedclothing item which is cornerless and can be mounted on different sized and/or thickness mattresses, said fitted bedclothing item comprising a top portion, opposite side portions defining lower edges, opposite end portions defining lower edges, and separate elastic segments connected between adjacent side and end portions to enable the bedclothing item to extend around and under the sides and ends of more than one size and/or thickness of mattress, with upper ends of the elastic segments being positioned below upper corners of the mattress, wherein each elastic segment has a generally straight bottom edge and an upper edge which extends from one end of the bottom edge to an opposite end along a curve, said curved upper edge generally conforming to an end portion of an ellipse.

2. A fitted bedclothing item according to claim 1, wherein each elastic segment is formed of elastic filaments.

3. A fitted bedclothing item according to claim 2, wherein each elastic segment is made of knitted or woven elastic filaments.

4. A fitted bedclothing item according to claim 1, wherein said elastic segments are stitched to adjacent side edges of said corner and end portions.

5. A fitted bedclothing item according to claim 1, including an elastic binder that extends along the lower edges of the side and end portions to cause lower areas of the side and end portions to extend inwardly under a lower surface of a mattress.

6. A fitted bedclothing item according to claim 1, which is made of cotton.

7. A fitted bedclothing item according to claim 1, which is made of linen.

8. A fitted bedclothing item according to claim 1, which is made of flannel.

9. A fitted bedclothing item according to claim 1, which is made of satin or sateen.

10. A fitted bedclothing item according to claim 1, which can fit both a twin and a twin XL mattress.

11. A fitted bedclothing item according to claim 1, which can fit both a full size and a queen size mattress.

12. A fitted bedclothing item according to claim 1, which is sized to fit both an Eastern king and a California king mattress.

13. A fitted bedclothing item according to claim 1, including separate elastic strips connected between respective side and end portions at each corner thereof.

14. A fitted bedclothing item according to claim 1, which is a fitted sheet.

15. A fitted bedclothing item according to claim 1, which is a fitted mattress pad.

16. A fitted bedclothing item according to claim 1, which is a fitted anti-allergy cover.

17. A fitted bedclothing item according to claim 1, which is a fitted blanket.

18. A fitted bedclothing item according to claim 1, which is a fitted coverlet.

19. A combination of a mattress defining a top surface, a bottom surface, sides and ends, and a fitted cornerless bedclothing item mounted thereon, said fitted bedclothing item comprising a top portion, opposite side portions defining lower edges, opposite end portions defining lower edges, and separate elastic segments connected between adjacent side and end portions to enable the bedclothing item to extend around and under the sides and ends of more than one size and/or thickness of mattress, said elastic segments when unstretched defining a generally straight bottom edge and an upper edge which extends from one end of said bottom edge to an opposite end thereof along a curve generally conforming to an end portion of an ellipse, an upper end of each segment being positioned below an upper corner of said mattress, said segments creating no pockets or ears.

20. A combination according to claim 19, wherein said elastic segments are located offset relative to corners of said mattress.

* * * * *